US010174746B2

(12) United States Patent
Conde et al.

(10) Patent No.: US 10,174,746 B2
(45) Date of Patent: Jan. 8, 2019

(54) PISTON DRIVE ASSEMBLY

(71) Applicant: S-RAM Dynamics, Franklin, TN (US)

(72) Inventors: Ricardo Conde, New Salem, MA (US); Richard Kruse, Fort Calhoun, NE (US); Lee Jestings, Franklin, TN (US)

( * ) Notice: Subject to any disclaimer, the term of this patent is extended or adjusted under 35 U.S.C. 154(b) by 225 days.

(21) Appl. No.: 14/957,532

(22) Filed: Dec. 2, 2015

(65) Prior Publication Data

US 2016/0160846 A1 Jun. 9, 2016

Related U.S. Application Data

(60) Provisional application No. 62/087,196, filed on Dec. 3, 2014.

(51) Int. Cl.

| | |
|---|---|
| ***F04B 1/16*** | (2006.01) |
| ***F04B 1/12*** | (2006.01) |
| ***F04B 1/14*** | (2006.01) |
| ***F04B 27/10*** | (2006.01) |

(52) U.S. Cl.

CPC ..... *F04B 1/16* (2013.01); *F04B 1/122* (2013.01); *F04B 1/146* (2013.01); *F04B 1/148* (2013.01); *F04B 27/109* (2013.01); *F04B 27/1036* (2013.01); *F04B 27/1054* (2013.01); *F04B 27/1063* (2013.01); *F04B 27/1072* (2013.01)

(58) Field of Classification Search

CPC ..... F04B 1/165; F04B 1/122; F04B 1/146; F04B 27/1036; F04B 27/1054

See application file for complete search history.

(56) References Cited

U.S. PATENT DOCUMENTS

| | | | | |
|---|---|---|---|---|
| 4,886,423 A * | 12/1989 | Iwanami | F04B 27/18 | 417/222.2 |
| 6,553,583 B1 * | 4/2003 | Pan | E03C 1/22 | 4/286 |
| 2011/0088546 A1 * | 4/2011 | Tagami | F04B 27/0895 | 91/506 |
| 2013/0229073 A1 * | 9/2013 | Momin | H02K 5/10 | 310/71 |

* cited by examiner

*Primary Examiner* — Thomas E Lazo
*Assistant Examiner* — Daniel S Collins
(74) *Attorney, Agent, or Firm* — Morriss O'Bryant Compagni Cannon, PLLC

(57) ABSTRACT

A piston drive assembly, including: a housing enclosing each of: a plurality of cylinders, each cylinder having an axis substantially parallel to the axis of the other cylinders; a plurality of pistons, one piston in each cylinder; a wobble plate connected to each of the plurality of pistons; a swash-plate rotatably fixed to a drive shaft such that the drive shaft can rotate the swash plate or the swash plate can rotate the drive shaft, wherein the drive shaft extends through the entire length of the housing.

19 Claims, 10 Drawing Sheets

PISTON DRIVE ASSEMBLY

CROSS-REFERENCE TO RELATED APPLICATIONS

This application claims the benefit of U.S. Provisional Application No. 62/087,196, filed Dec. 3, 2014, which is hereby incorporated by reference herein in its entirety, including but not limited to those portions that specifically appear hereinafter, the incorporation by reference being made with the following exception: in the event that any portion of the above-referenced application is inconsistent with this application, this application superseded said above-referenced application.

STATEMENT REGARDING FEDERALLY SPONSORED RESEARCH OR DEVELOPMENT

Not Applicable.

BACKGROUND OF THE INVENTION

The invention relates to a fixed displacement piston drive assembly, which utilizes double ended piston assemblies that can facilitate compression and expansion of desired gases and liquids, while maintaining or reducing torsional forces and stresses on the piston drive joints and related components, thus increasing the efficiency and life of the piston drive assembly.

Conventional compression/expansion systems often include a constant or variable speed motor and a set of single-sided pistons, in contrast to doubled ended or opposed pistons. However, conventional compression systems struggle with inefficiencies due to axial loads placed on the pistons which can lead to early failure of the pistons, cylinders or other constraint components. Additionally, single-sided pistons can also struggle with inefficiencies because work and energy is lost, or failed to be recovered, during at least one of the compression or expansion strokes.

What is needed is constraint system that enables pistons to handle higher axial loads while minimizing, or reducing, corresponding friction. Additionally, there is a need to recover losses and inefficiencies that stem from single-sided pistons, by incorporating an opposed or double ended piston configuration which can recover such losses which can typically occur during either the compression or expansion stroke of a single-sided piston configuration.

Many piston driven systems have pistons that are attached to offset portions of a crankshaft such that as the pistons are moved in a reciprocal direction transverse to the axis of the crankshaft, the crankshaft will rotate.

U.S. Pat. No. 5,535,709, defines an engine that is attached to a crankshaft with an offset portion. A lever attached between the piston and the crankshaft is restrained in a fulcrum regulator to provide the rotating motion to the crankshaft.

U.S. Pat. No. 4,011,842, defines a four cylinder piston engine that utilizes pistons connected to a T-shaped connecting member that causes a crankshaft to rotate. The T-shaped connecting member is attached at each of the T-cross arm to a double ended piston. A centrally located point on the T-cross arm is rotatably attached to a fixed point, and the bottom of the T is rotatably attached to a crank pin which is connected to the crankshaft by a crankthrow which includes a counter weight.

In each of the above examples, pistons are used that drive a crankshaft that has an axis transverse to the axis of the pistons.

Conventionally it has been established that a wobble plate, in order for necessary balance, must be restrained in a manner such that all parts of the wobble plate move in a lemniscate path. The wobble plate can be restrained, for example, by means of a stationary gear in mesh with a gear of equal number of teeth which is attached to corresponding swash plate. A disadvantage of a gear system is the relative limited strength of the gear teeth, and the need for significant and continuous lubrication. Other methods for restraining the wobble plate have also include the use of a Cardan (or a universal joint), double-Cardan, Thomson joint and constant velocity joints. Cardan, double-Cardan and Thomson joints can operate with reduced or no oil lubrication, but have limited load and speed capability which can significantly reduce the scope of applications that can utilize such a system. Constant velocity joints can handle higher speeds although require grease and also are limited in the amount of torque they can handle without becoming excessively large. Additionally, oil or other lubrications required in conventional piston drive systems, often mixes with the working fluid, which can cause additional inefficiencies. Thus, a system is needed that keeps oil, or other lubrication, separate from the working fluid, while maintaining proper lubrication of the friction inducing parts of the system.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
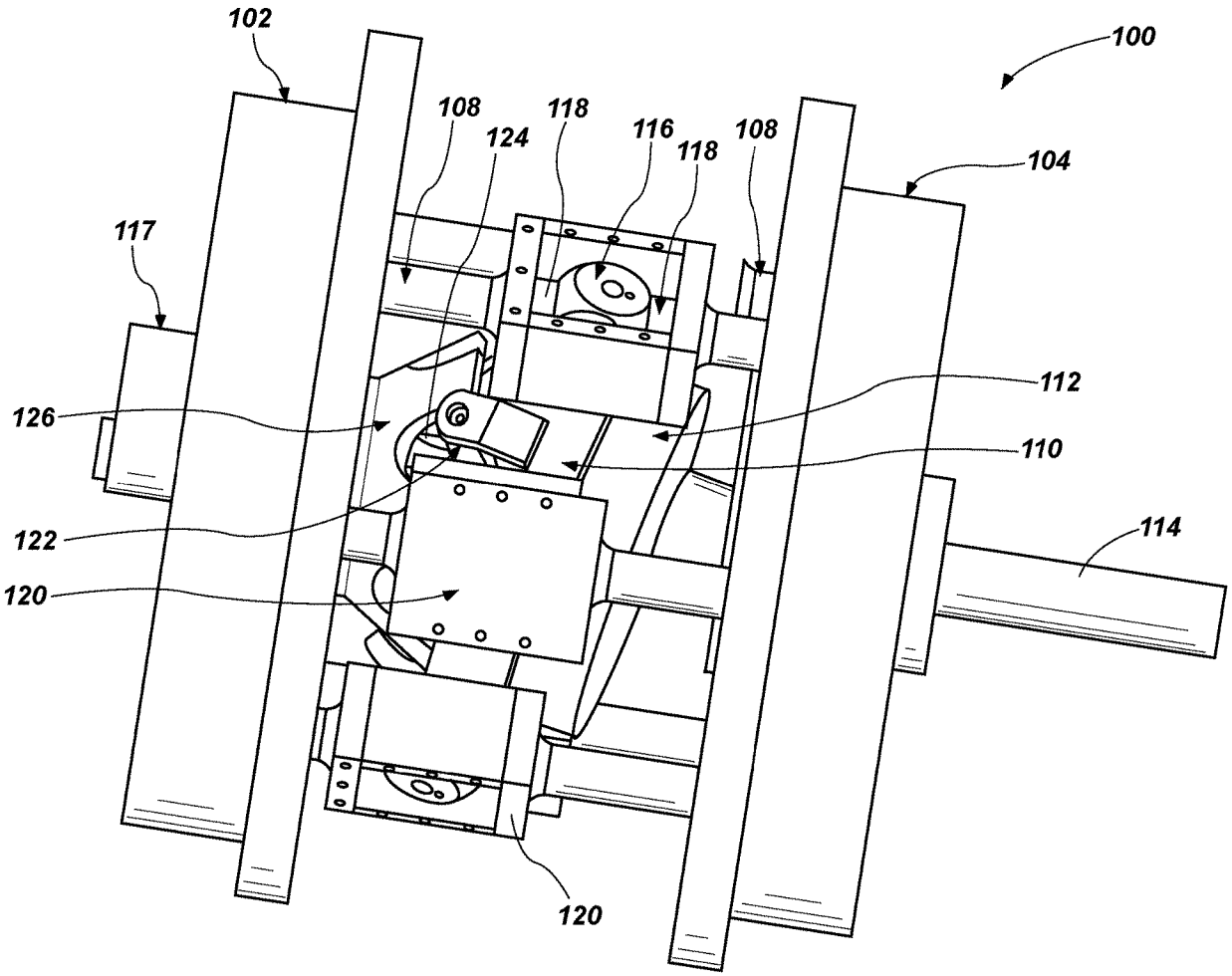
FIG. 1 is a perspective side view of a piston drive assembly of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, un-recited elements or method steps.

Figure 2:
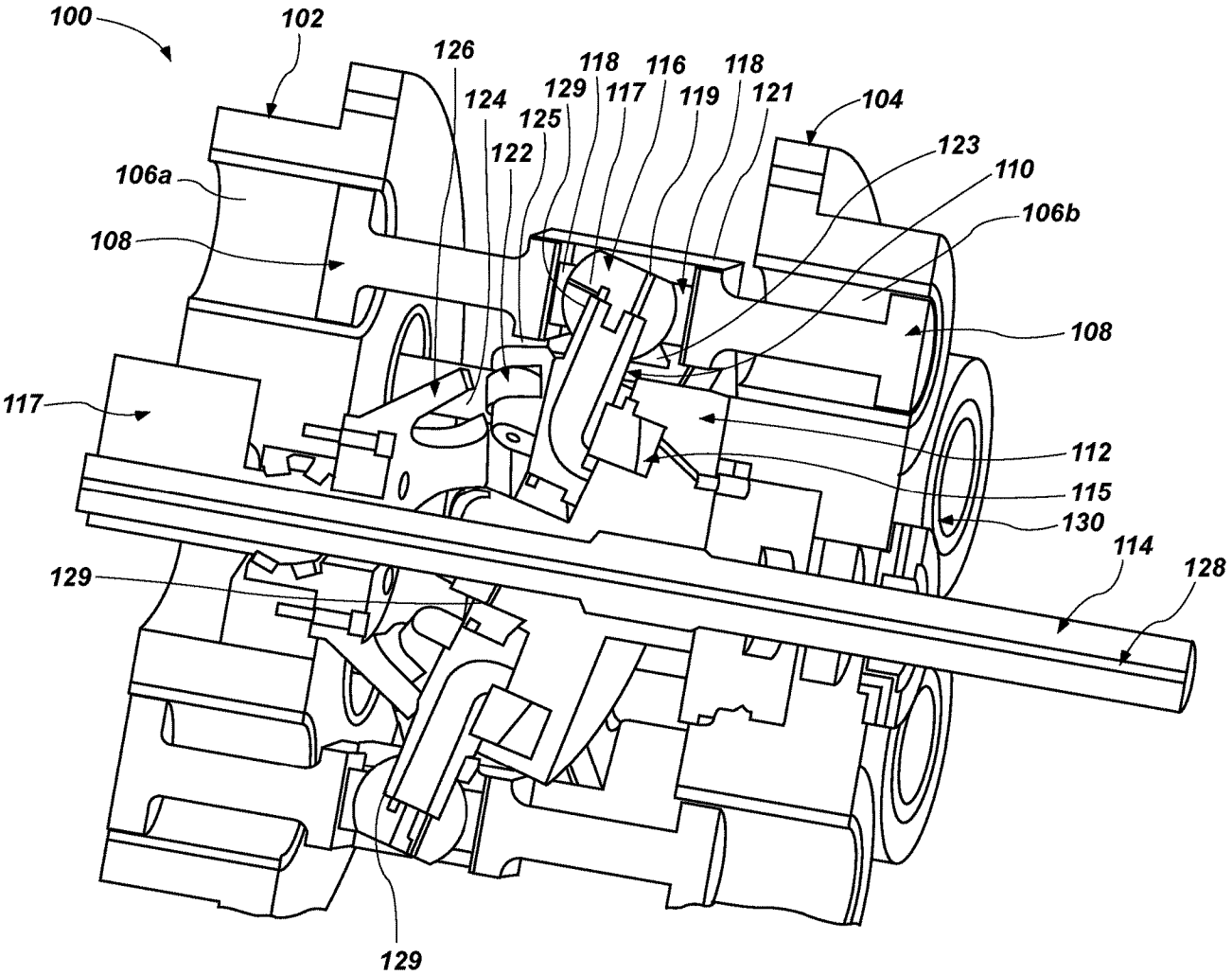
FIG. 2 is a cross-sectional view of the embodiment shown in FIG. 1.
Figure 3:
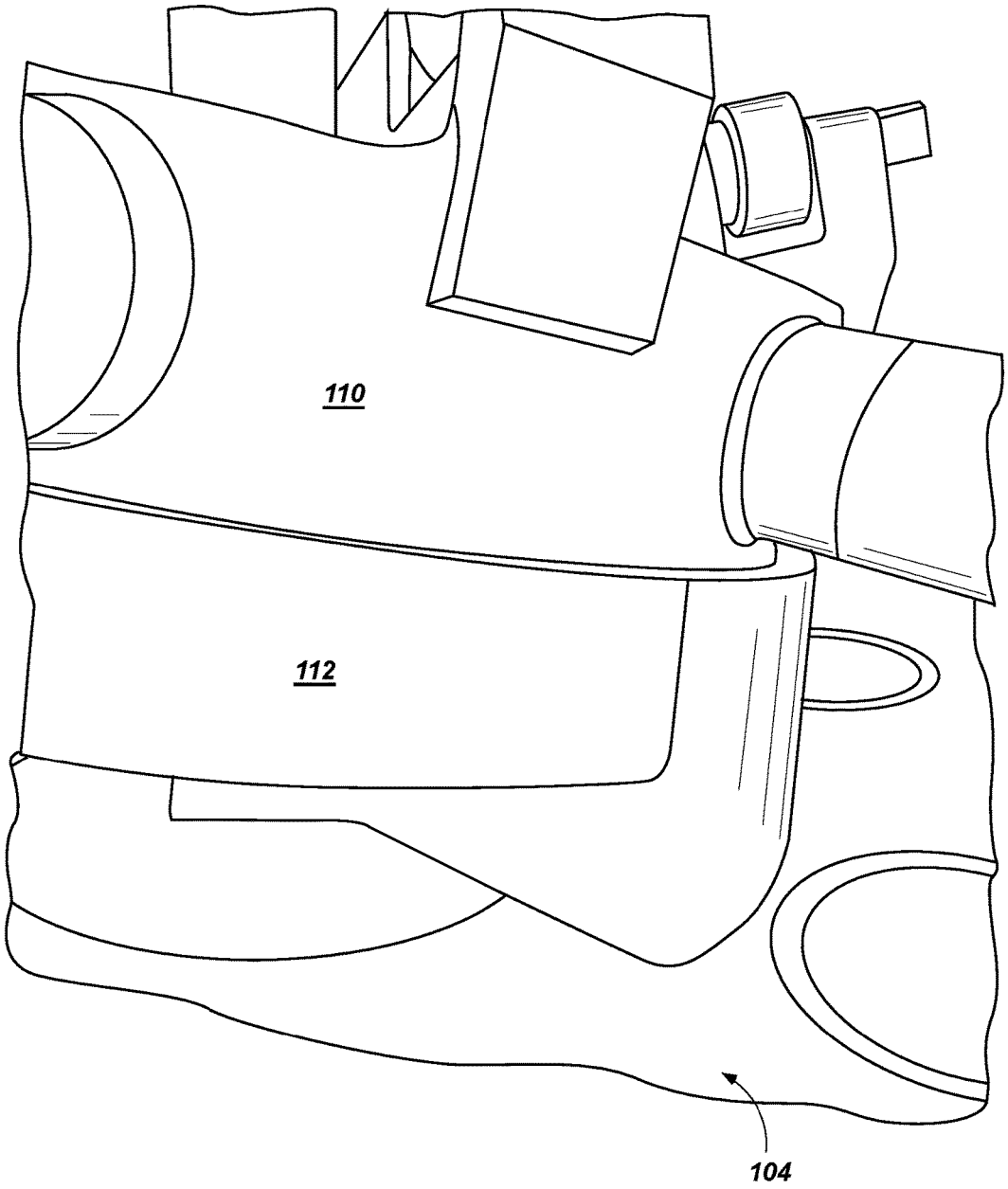
FIG. 3 is a perspective side view of a swash plate and wobble plate of the an embodiment of the present disclosure.
Figure 4:
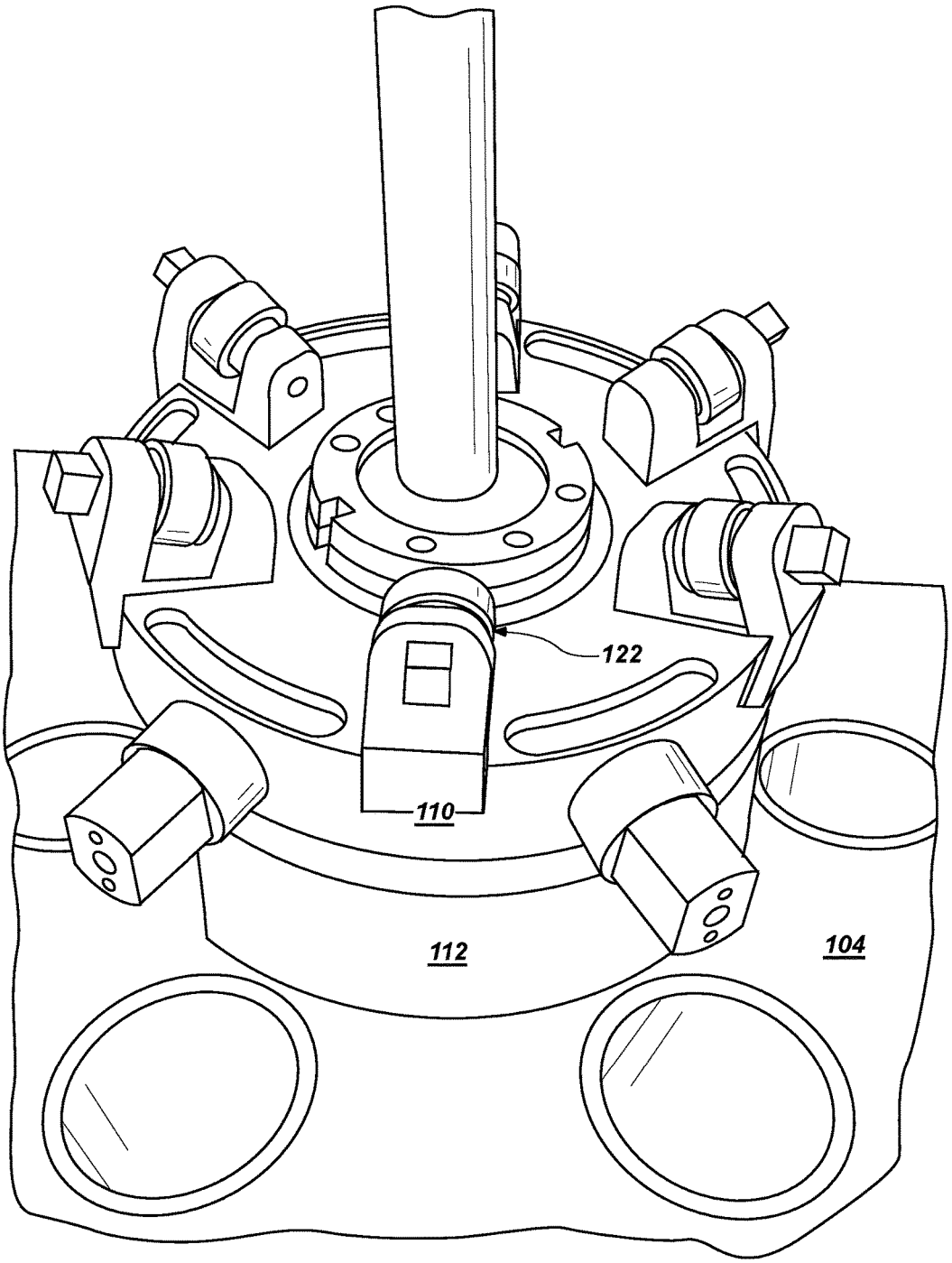
FIG. 4 is a perspective top view of a swash plate, wobble plate and cylinder head of an embodiment of the present disclosure.
Figure 5:
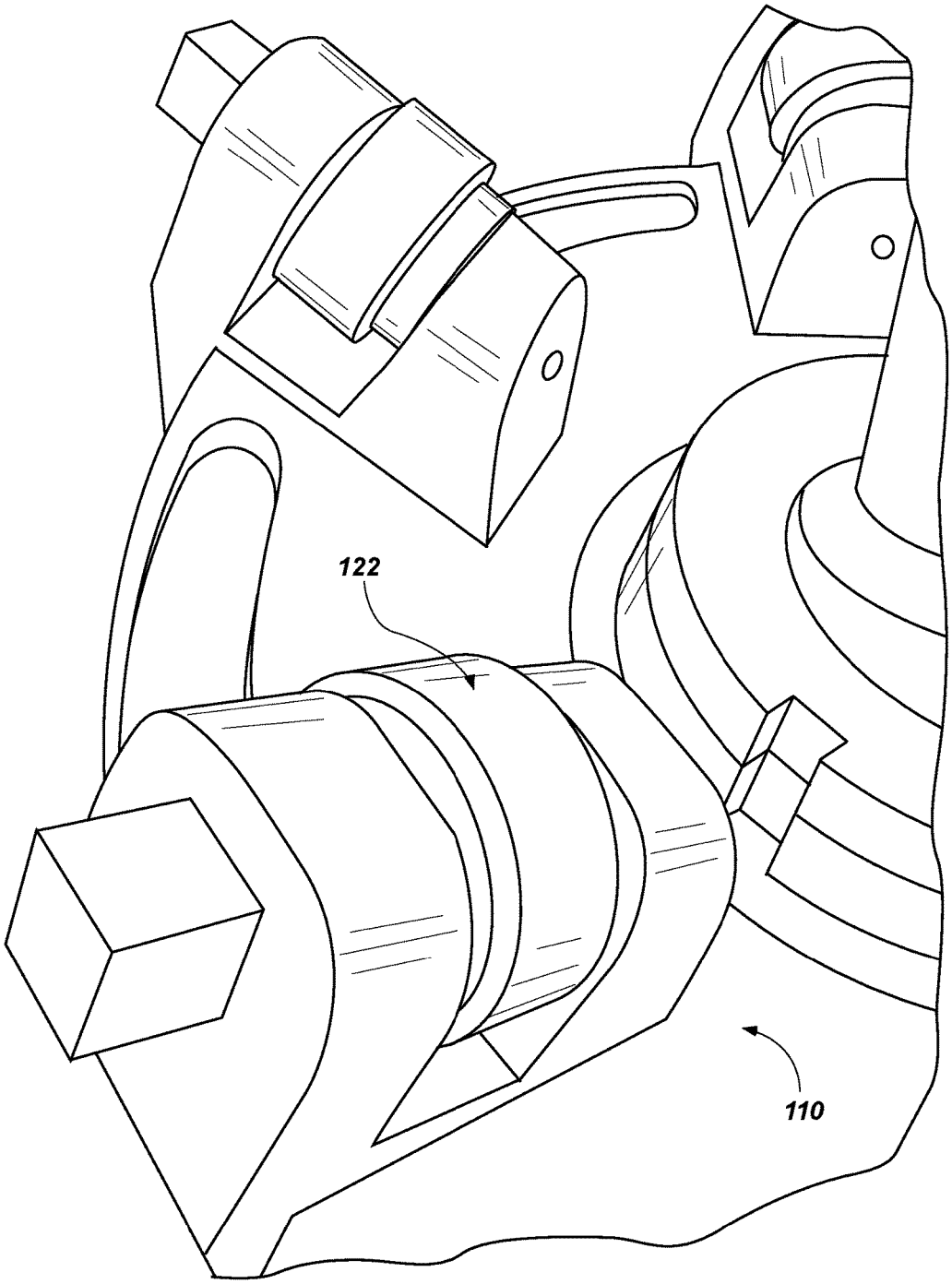
FIG. 5 is a zoomed-in perspective view of a roller assembly of the an embodiment of the present disclosure.
Figure 6:
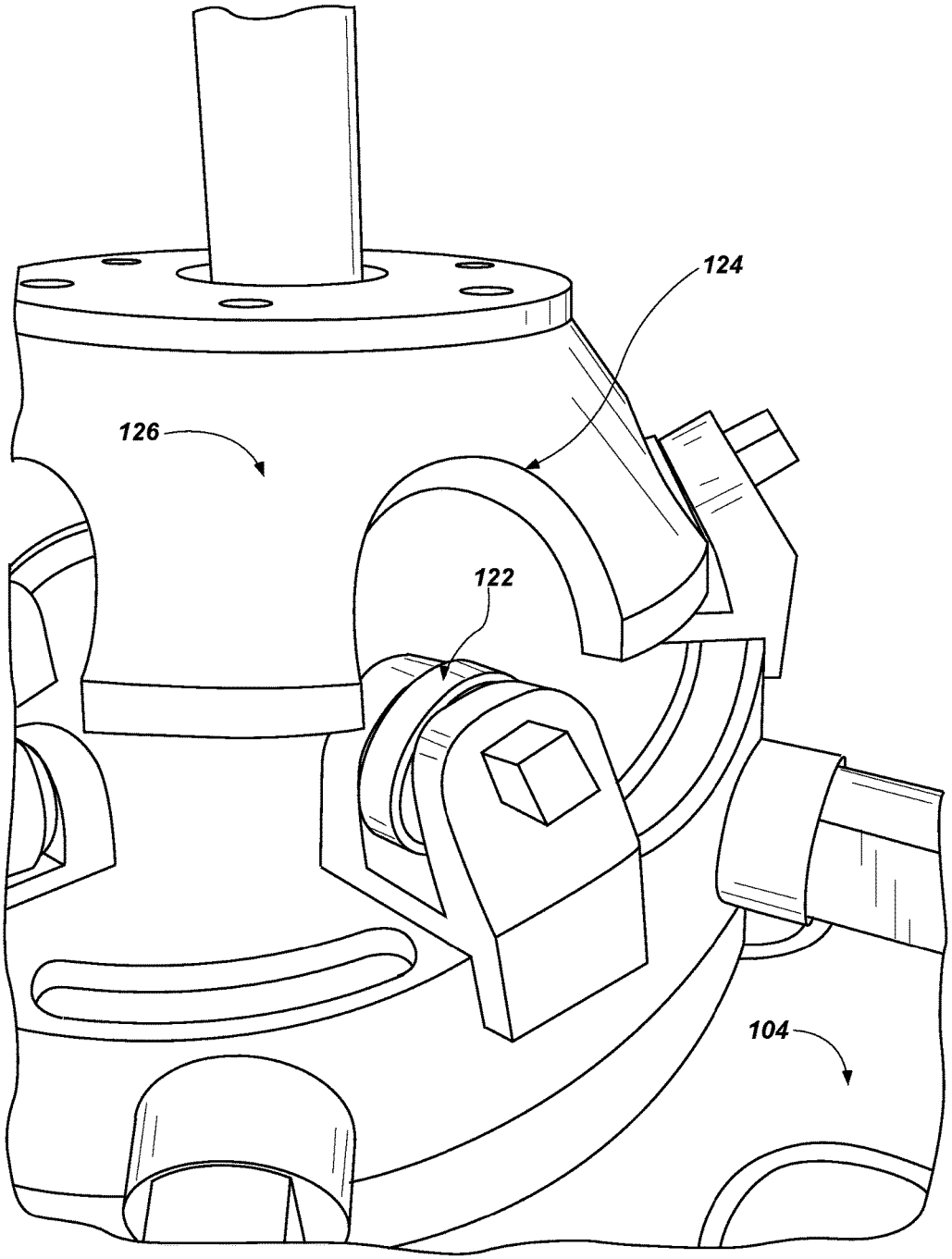
FIG. 6 is a perspective side view of a crown restraint and swash plate of an embodiment of the present disclosure.
Figure 7:
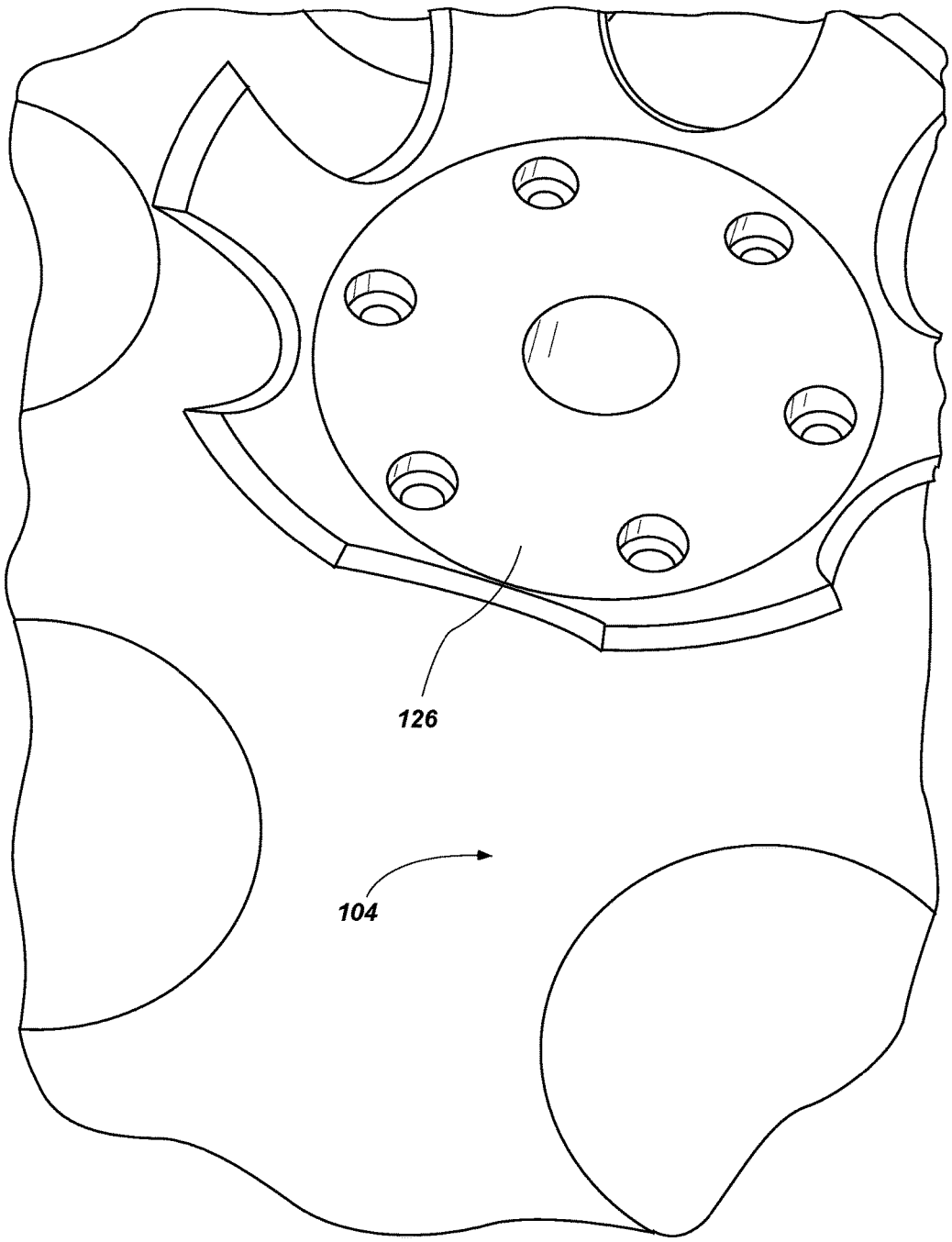
FIG. 7 is a perspective bottom view of a crown restraint of an embodiment of the present disclosure.
Figure 8:
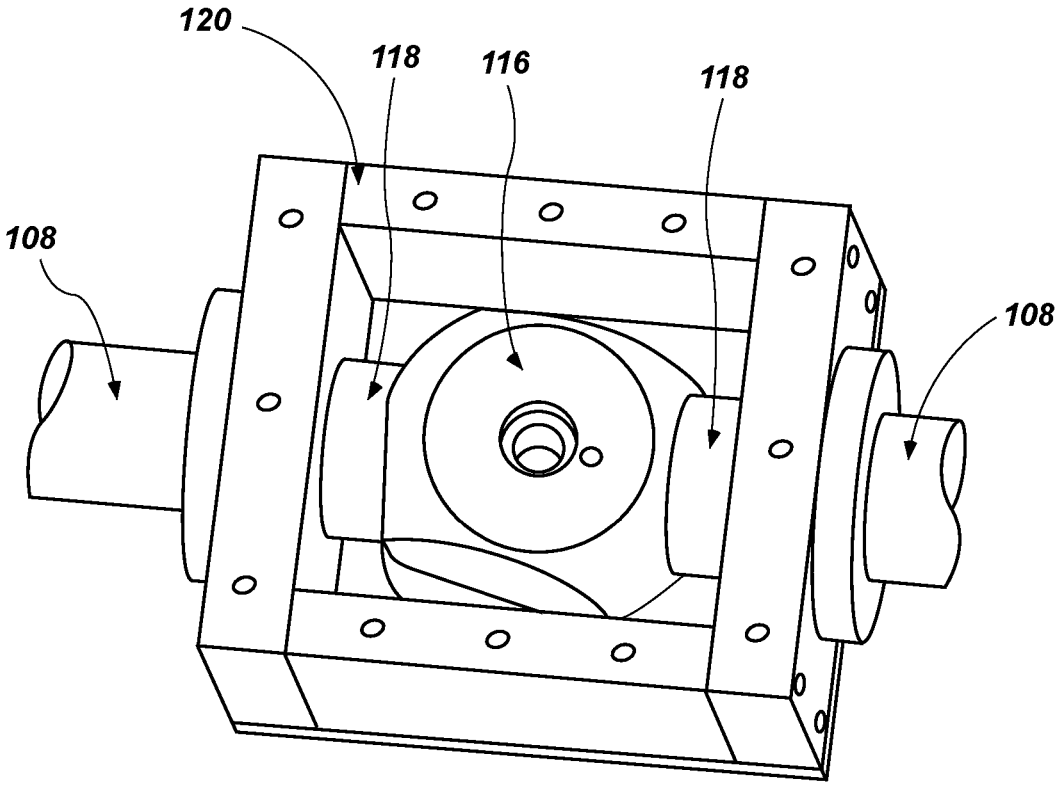
FIG. 8 is a zoomed-in perspective view of a box joint of an embodiment of the present disclosure.
Figure 9:
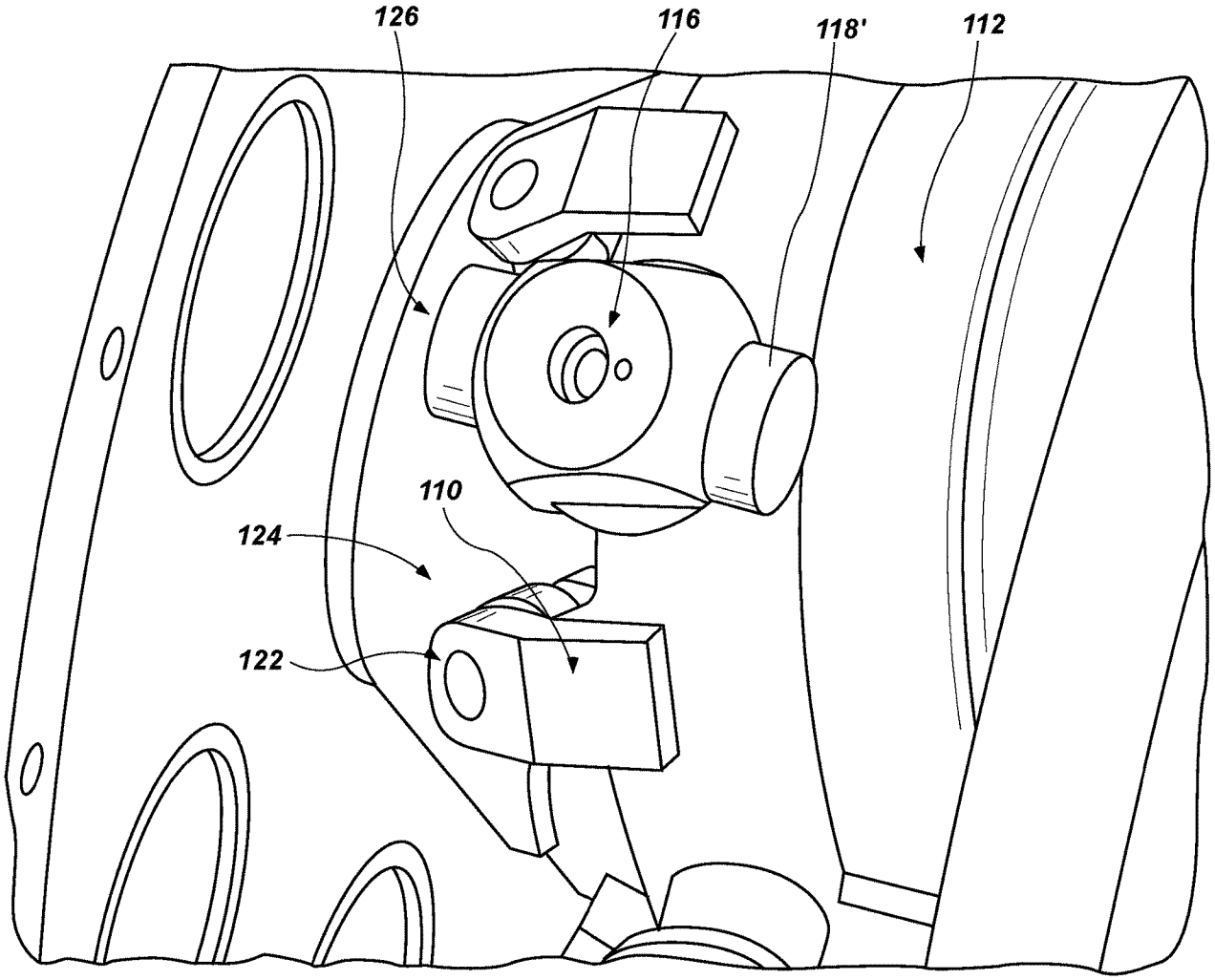
FIG. 9 is a zoomed-in perspective view of a wobble plate ball with the box joint removed, in an embodiment of the present disclosure.
Figure 10:
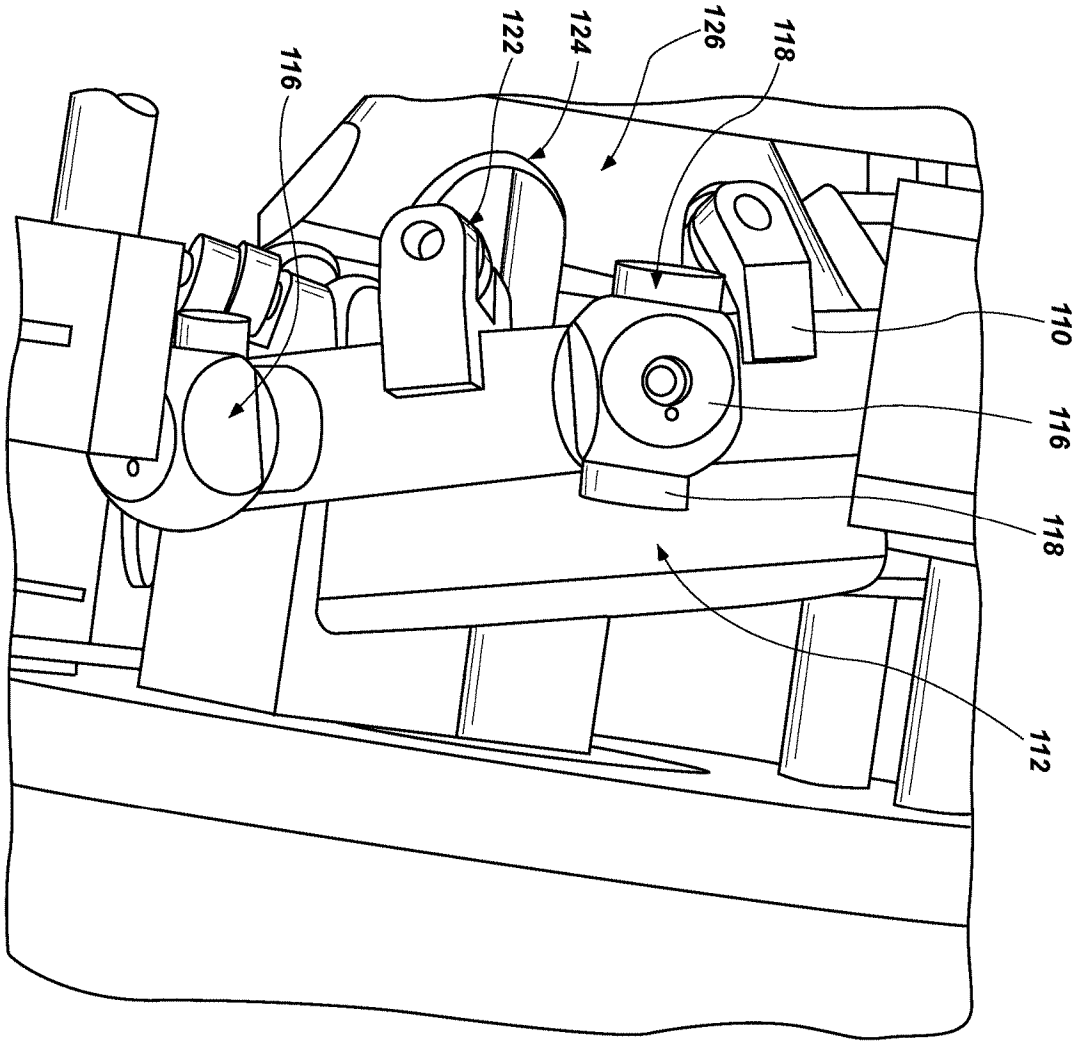
FIG. 10 is a perspective bottom view of a crown restraint and wobble plate, with the box joint removed, in an embodiment of the present disclosure.

FIGS. 1-2 disclose a piston drive assembly 100 of the present disclosure. The piston drive assembly 100 includes a first cylinder head 102 and an opposing second cylinder head 104. Each of the first and second cylinder heads 102 and 104 house six cylinders 106, although additional or fewer cylinders can be used as desired. Each cylinder 106 is configured to receive a corresponding piston 108. Each piston 108 is double-ended, having a first end that is received by a cylinder 106*a* in the first cylinder head 102 and a second end, opposite the first end, that is received by a cylinder 106*b* in the second cylinder head 104.

This double-ended piston configuration improves the overall efficiency of the piston drive assembly 100 as each stroke can be utilized to compress gases within a cylinder 106*a* or 106*b* of either the first cylinder head 102 or the second cylinder head 104. Each of the cylinders 106*a* and 106*b* of the first and second cylinder heads 102 and 104 can be alternatively used for expansion purposes, if desired and configured by the user. Additionally, the piston drive assembly 100 can be configured as a double ended compressor or one end a compressor and the other end an expander, or both ends as either compressors or expanders for use in other desired applications.

In a disclosed embodiment, the double-ended, opposed, pistons 108 can be driven by a wobble plate 110 to reciprocate the pistons 108 within the corresponding cylinders 106*a* and 106*b*. The wobble plate 110 is engaged with and driven by a swash plate 112, which is driven rotationally by the drive shaft 114. The wobble plate 110 is engaged with the swash plate 112 via anti-friction bearings 115, or other desired bearings, which enables the swash plate 112 to rotate while the wobble plate 110 remains rotationally fixed, enabling the wobble plate to "wobble" as the swash plate 112 rotates. The wobble plate 110 is rotationally fixed by a modified mating gear restraint (not shown), or another conventional constraint known in the art. The drive shaft 114 can extend through the entire piston drive assembly 100, including the corresponding housing (not shown), which can enable the drive shalt 114 to drive an additional desired mechanism or application, which can improve the overall energy efficiency of the system (piston drive assembly and the additional mechanism or application). A counter-weight 117 is also rotationally fixed to the drive shaft 114 to counter-balance the rotational forces of the swash plate 112 during operation, reducing or preventing unwanted vibration and movement in the piston drive assembly 100. Without the counter-weight 117 the corresponding vibration and movement caused by the rapid rotation of the swashplate 112 can cause significant fatigue in the drive shaft 114 and in other joints and connections throughout the piston drive assembly 100, resulting in a significantly reduced life and the overall efficiency of the piston drive assembly 100.

Wobble plate balls 116 are fixed to, and radially extend from, the wobble plate 110 equidistant from one another and corresponding to each of the double-ended pistons 108. These wobble plate balls 116 can be generally spherical in shape, having a smooth, curved, exterior surface. Each wobble plate ball 116 contacts friction reducing pads 118 on at least two sides, corresponding to each of the first and second sides of the corresponding piston 108. These wobble plate balls 116 impart linear motion to the double-ended pistons 108 as the wobble plate 110 "wobbles." Each of the wobble plate balls 116 and corresponding pads 118 are housed within a corresponding box joint 120.

The box joints 120 include four sides, one side 121 being removable to allow maintenance of the box joint 120 (side 121 is removed in FIG. 1, and another side having an opening to enable the wobble plate ball 116 to extend into the box joint 120 which is sealed by a bellows 123 which surrounds the shaft extending the wobble ball 116 into the box joint 120. The bellows 123 provide a pliable seal to the box joint 120 and seals fluid (oil for example) within the box joint 120. The box joints 120 are sealed such that they can retain liquid, such as lubrication. A closed loop, pressurized, lubrication system can be used to lubricate the moving parts inside each box joint 120. Since the lubrication can be retained within each box joint 120 and the bearings 115, the working fluid within the cylinders 106*a* and 106*b* (being compressed and expanded), can be free from oil or lubrication.

The wobble plate 110 also includes a plurality of cam rollers 122 which are retained within corresponding notches 124 in a restraint crown 126. Each roller 122 is secured to and extends from the wobble plate 110, equidistant from one another about the circumference of the wobble plate 110, and located circumferentially between each wobble plate ball 116. The crown 126 is secured to the first cylinder head 102, which prevents movement, rotational or lateral, of the crown 126. The notches 124 are formed in the crown 126 and are spaced to correspond with each roller 122. The shape and profile of each the notches 124, specifically the internal wall of the notch 124, facilitates and restrains the lemniscate motion of the wobble plate 110. The size and profile of the notches 124 can be determined by the roller 122 diameter, distance of the roller center to the shaft axial center and the angle of the swashplate 112.

The restraint crown 126 provides additional strength and support for higher restraint forces than traditional gear restraint systems, and the crown 126 requires little to no lubrication, in contrast to traditional gear restraint systems. Additionally, due to the elimination of precision ground gears, the crown 126 and roller 122 configuration can significantly reduce manufacturing and maintenance costs of the restraint system.

FIG. 2 also discloses, a closed loop oil circulation system used to lubricate the drive bearings 115 and the components within the box joints 120. The circulation oil of the circulation system can also be used to extract heat from the drive assembly 100, thereby reducing or eliminating the need for a secondary cooling system. The circulation oil can be pumped from a reservoir (not shown) at the bottom of the drive assembly 100. The oil enters and exits the unit through a rotary union (not shown) positioned at the bottom and on the drive shaft 114. The oil enters a port of the rotary union which is in communication with a cavity around the drive shaft 114. The cavity is sealed by means of rotary seals to prevent leaking of the oil. A hole in the drive shaft 114 is positioned in the cavity and allows the oil to enter the drive shaft 114 and travel through an axial inlet passage 128 in the drive shaft 114. The oil can exit the drive shaft 114 through a separate passage positioned at the swash plate 112.

The drive shaft 114 rotates with the swash plate 112 and the oil travels through the passageway in the swash plate 112 and fills the cavity containing drive bearings 115. The oil can then pass through the drive bearing 115 and through passages 129 in the wobble plate 110 that lead to each box joint 120. The wobble plate 110 has two passages 129 for the oil to feed the wobble plate balls 116 at the corresponding box joint 120 and to return the lower pressure oil back to the reservoir. The pressurized oil entering the wobble plate balls 116 travels through a hole 117 and then enters a series of grooves that are machined into bearing pads 118. The bearing pads 118 are flat on one side, to be capable of lateral motion, and the side opposite to the flat side of the bearing pads is substantially semi-spherical, allowing rotary motion complementary with the corresponding wobble plate ball 116. The oil lubricates the bearing pad 118 on both sides reducing friction, while simultaneously removing heat from high stress areas.

The oil then fills into the box joint 120 which can be sealed with 5 static sealed sides and one dynamic seal which seals around the wobble ball 116. The oil can then exit the box joint 120 via a second hole 119 in the wobble plate ball 116 which is connected to the return hole in the wobble plate 110. Oil flows by gravity back to the swash plate 112 and lubricates the main thrust bearing. The swash plate 112 can be positioned at a fixed angle, and at the bottom of the swash plate 112 is an oil passage where the oil continues to flow by gravity through a thrust plate. The thrust plate rests on the secondary thrust bearing and contains seals to contain and prevent leakage of the oil. Oil then passes through the thrust bearing and then a radial bearing.

Positioned beneath the radial bearing is a cavity that is contained by the rotary union. A second hole on the surface of the rotary union allows the oil to flow out to an oil cooler (not shown), where the generated heat is removed, and then back to the reservoir.

The box joints 120 can function as individual interfaces between the opposed pistons 108 and the wobble plate 110. As briefly discussed above, the box joints 120 include four "closed" sides and two "open" sides, sized to fit a corresponding wobble plate ball 116 and bearing pads 118 within the corresponding box joint 120 and allow motion of these components within the corresponding box joint 120. One "open" side 121 facilitates access to the box joint 120 for assembly and maintenance and includes a cover plate and gasket to seal the box joint 120 during operation. The other, or second, "open" side enables connection between the wobble ball 116, which is inside the box joint 120, and the wobble plate 110, which is exterior to the box joint 120. However, the box joints 120 are fluidically sealed such that oil or other lubricant can be retained within the box joint 120 without leaking into the interior housing of the system 100.

The box joints 120 can include a plate 125 having a hole positioned to correspond to the center of the wobble ball 116. A metal bellows 123 can then be attached to the plate 125 and a dynamic seal can be attached to the bellows 123. This seal can be compressed against the wobble ball 116 by a spring force initiated by the bellows 123. As the wobble plate 110 nutates around a wobble plane the wobble plate balls 116 follow a path of lemniscate motion. Inside the box joint 120 the wobble plate ball 116 and bearing pads 118 follow a lateral motion in a small circle. Simultaneously, the wobble plate ball 116 is also rotating both clockwise and then counter clockwise. The angle the wobble plate ball 116 rotates in both clockwise and counter-clockwise directions is equal to the angle of the swash plate 112. The bellows 123 can provide a continuous force on the seal during operation, and non-operation, to maintain contact with the wobble plate ball 116 while also allowing the wobble plate ball 116 to move axially, radial and rotationally.

As shown in FIGS. 1-10, and briefly discussed above, the rotating swash plate 112 maintains direct mechanical communication with the non-rotating wobble plate 110. Between the wobble plate 110 and the swash plate 112 is a thrust bearing which supports the axial loads on the wobble plate 110 along with an angular contact roller bearing to support radial loads on the wobble plate 110. The wobble plate 110 and swash plate 112 enclose the bearings with seals to provide a contained oil path for reduced friction and removal of heat generated by the piston drive assembly 100. A hole through the swash plate 112 receives the drive shaft which is keyed to the swashplate 112, rotationally fixing the swash plate to the drive shaft 114. This allows the drive shaft 114 to rotate with the swash plate 112 which can either drive or be driven by the wobble plate 110, depending on the desired application and system. Seals around the drive shaft 114 can contain the oil which is provided through the drive shaft 114. The drive shaft 114 is also supported at both axial ends with radial bearings and an additional thrust bearing, utilized to support loads created by the actuation of the pistons 108.

An advantage of disclosed piston drive assembly 100 includes a more compact size in the axial direction which can reduce the overall length of the piston drive assembly 100. Additionally, the support bearings at either end of the drive shaft 114 can be closer together which can reduce the drive shaft 114 diameter required to support larger loads. An additional advantage of the disclosed piston drive assembly 100 can also include the contained oil system which allows for lubrication without contaminating the inside of the housing/case or coming into contact with the working gas of the system within the cylinders 106*a* and 106*b*.

The present disclosure may include a piston drive assembly, including: a housing enclosing each of: a plurality of cylinders, each cylinder having an axis substantially parallel to the axis of the other cylinders; a plurality of pistons, one piston in each cylinder; a wobble plate connected to each of the plurality of pistons; a swashplate rotatably fixed to a drive shaft such that the drive shaft can rotate the swash plate or the swash plate can rotate the drive shaft, wherein the drive shaft extends through the entire length of the housing.

An embodiment of the piston drive assembly may also include a crown restraint which restricts the motion of the wobble plate to a lemniscate path. The crown restrain may include a plurality of notches configured to receive corresponding rollers fixed to the wobble plate. The rollers configured to engage an interior surface of the notches, and the interior surface of the notches forming a lemniscate path.

An embodiment of the piston drive assembly may also include a closed-loop oil lubrication and heat dissipation system.

An embodiment of the piston drive assembly may also include a crown restraint which restricts the motion of the wobble plate to a lemniscate path.

An embodiment of the piston drive assembly may also include double-ended pistons, each double ended piston reciprocating within cylinders positioned at opposite sides of the piston drive assembly.

The present disclosure may include a piston drive assembly, including: a housing enclosing each of: a plurality of cylinders, each cylinder having an axis substantially parallel to the axis of the other cylinders; a plurality of pistons, one piston in each cylinder; a wobble plate connected to each of the plurality of pistons via a corresponding box joint; the wobble plate including a plurality of wobble balls extending therefrom, each of the wobble balls being enclosed within the corresponding box joint, reducing stress on the connection between the pistons and the wobble plate; a swashplate rotatably fixed to a drive shaft such that the drive shaft can rotate the swash plate or the swash plate can rotate the drive shaft, wherein the drive shaft extends through the entire length of the housing.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as any claims may reflect, inventive aspects lie in less than all features of a single foregoing disclosed embodiment. Thus, any claim may be hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed:

1. A piston drive assembly comprising:

a housing enclosing each of:

a plurality of cylinders, each cylinder having an axis substantially parallel to the axis of the other cylinders;

a plurality of pistons, one piston in each cylinder;

a wobble plate connected to each of the plurality of pistons;

a swash plate rotatably fixed to a drive shaft configured and arranged such that the drive shaft can rotate the swash plate or the swash plate can rotate the drive shaft; and a crown restraint configured and arranged to restrict the motion of the wobble plate to a lemniscate path, and wherein the crown restraint also includes a plurality of notches configured to receive corresponding rollers fixed to the wobble plate.

2. The piston drive assembly of claim 1, wherein the drive shaft extends through an entire length of the housing.

3. The piston drive assembly of claim 1, wherein the rollers are configured to engage an interior surface of the notches, and the interior surface of the notches is configured and arranged to form a lemniscate path of movement of the rollers.

4. The piston drive assembly of claim 1, further comprising:

a closed-loop oil lubrication and heat dissipation system.

5. The piston drive assembly of claim 1, further comprising a plurality of double-ended pistons, each double ended piston being configured and arranged to reciprocate within corresponding cylinders positioned at opposite ends of the piston drive assembly.

6. The piston drive assembly of claim 1, wherein the wobble plate is connected to each of the plurality of pistons via a corresponding box joint.

7. The piston drive assembly of claim 6, wherein the wobble plate includes:

a plurality of wobble plate balls extending from the wobble plate, each of the wobble plate balls being enclosed within the corresponding box joint to thereby reduce stress on the connection between the pistons and the wobble plate.

8. The piston drive assembly of claim 7, wherein the box joint is fluidicially sealed, such that a lubricant is retained within the box joint.

9. The piston drive assembly of claim 4, further characterized by:

an absence of a secondary heat dissipation system, in addition to the presence of the closed-loop oil lubrication and heat dissipation system.

10. A piston drive assembly comprising:

a housing enclosing each of:

a plurality of cylinders, each cylinder having an axis substantially parallel to the axis of the other cylinders;

a plurality of pistons, one piston positioned within each cylinder;

a wobble plate connected to each of the plurality of pistons via a corresponding box joint;

the wobble plate including:

a plurality of wobble plate balls extending from the wobble plate, each of the wobble plate balls being enclosed within the corresponding box joint to thereby reduce stress on the connection between the pistons and the wobble plate; and a swash plate rotatably fixed to a drive shaft and configured and arranged such that the drive shaft can rotate the swash plate.

11. The piston drive assembly of claim 10, wherein the drive shaft extends through an entire length of the housing.

12. The piston drive assembly of claim 10, further comprises:

a crown restraint configured and arranged to restrict the motion of the wobble plate to a lemniscate path.

13. The piston drive assembly of claim 12, wherein the crown restraint includes:

a plurality of notches configured to receive corresponding rollers fixed to the wobble plate.

14. The piston drive assembly of claim 13, wherein the rollers are configured to engage an interior surface of the notches, and the interior surface of the notches forms facilitates a lemniscate path of movement of the rollers.

15. The piston drive assembly of claim 10, further comprising:

a closed-loop oil lubrication and heat dissipation system.

16. The piston drive assembly of claim 11, further comprising:

a plurality of double-ended pistons, each double ended piston being configured and arranged to reciprocate within corresponding cylinders positioned at opposite ends of the piston drive assembly.

17. The piston drive assembly of claim 15, wherein the oil lubrication does not enter any of the plurality of cylinders.

18. The piston drive assembly of claim 10, wherein each of the box joints are fluidicially sealed, such that a lubricant is retained within the box joint.

19. The piston drive assembly of claim 15, further characterized by:

an absence of a secondary heat dissipation system, in addition to the presence of the closed-loop oil lubrication and heat dissipation system.

* * * * *